United States Patent [19]

Hess

[11] 4,403,363

[45] Sep. 13, 1983

[54] PIPE THREAD CLEANER

[76] Inventor: John L. Hess, Rte. 1 Box 87B-4, Carencro, La. 70520

[21] Appl. No.: 184,081

[22] Filed: Sep. 4, 1980

[51] Int. Cl.[3] ..... B08B 9/02

[52] U.S. Cl. ..... 15/104.04; 15/88; 15/104.05

[58] Field of Search ..... 15/21 R, 23, 24, 50 R, 15/50 C, 56, 71, 75, 88, 97 R, 104.03, 104.04, 104.05, 104.1 R

[56] References Cited

U.S. PATENT DOCUMENTS

| | | | |
|---|---|---|---|
| 1,559,479 | 10/1925 | Ushatch | 15/50 R |
| 2,635,393 | 4/1953 | Barth | 15/88 X |
| 2,843,866 | 7/1958 | Hancock | 15/50 R |
| 4,011,617 | 3/1977 | Toelke et al. | 15/88 |
| 4,014,062 | 3/1977 | Scott et al. | 15/104.04 |

FOREIGN PATENT DOCUMENTS

| | | | |
|---|---|---|---|
| 831797 | 1/1970 | Canada | 15/104.03 |

*Primary Examiner*—Edward L. Roberts
*Attorney, Agent, or Firm*—Guy E. Matthews

[57] ABSTRACT

A power operated cleaner for large pipe threads is disclosed that includes a lightweight portable unit connected by flexible lines to power sources and to storage tanks. Both mechanical and chemical cleaning means are provided together with means to recover spent cleaning fluid and matter removed from the pipe ends, so as to protect the environment. Controls are located on the portable unit for both safety and operating efficiency.

9 Claims, 3 Drawing Figures

PIPE THREAD CLEANER

FIELD OF THE INVENTION

The drilling and completion of oil and gas wells require the use of many joints of drill pipe, casing and tubing in a variety of sizes, weights and grades. Such joints usually have a male thread on one end and a female thread on the other end to allow assembly of many joints into a single string of pipe as it is lowered into the bore hole. Before makeup of each threaded joint, both the male and female thread must be cleaned under oilfield conditions to prevent galling, leakage and/or improper makeup. Oilfield conditions include mud and rough terrain in remote areas.

BACKGROUND OF THE INVENTION

For many years oilfield pipe threads have been cleaned with hand-held wire brushes and more recently, power-driven rotary brushes have come into use. Some rotary brushes are highly portable but allow strong cleaning fluids to be thrown about which is environmentally unacceptable. Other rotary brush systems have provision to collect spent cleaning fluids and residue but are not truly portable and cannot be readily used for general oilfield service on horizontal or vertical pipe under all weather oilfield conditions.

Gibson (U.S. Pat. No. 3,435,479) discloses a radial adjustment of rotary brushes but no spent fluid collection means.

Hitt (U.S. Pat. No. 3,405,417) claims a factory type roll cleaning apparatus having a flexible drive to the roll and a "sleeve" containing stationary brushes and spent fluid collection means. However, to prevent "sleeve 30" from rotating, a roll frame member must be present to abut "bracket 58" to prevent rotation of "sleeve 30" with the roll and no unitary assembly is disclosed.

McCartney (U.S. Pat. No. 3,436,783) shows means to introduce fluid to rotary brushes driven by a conventional hand-held power drill but discloses no spent fluid collection means.

Scott (U.S. Pat. No. 4,014,062) and Toelke (U.S. Pat. No. 4,011,617) deal with stationary systems for use on the floor of a drilling rig where a lower pipe member is present to prevent rotation of the housing as rotary brushes are driven by a close coupled power unit.

Although prior art discloses the use of rotary brushes to clean pipe threads and also discloses the recovery of cleaning fluids, none of such prior art discloses a single, compact and lightweight unit that can be manually placed over the end of a vertical pipe or a horizontal pipe in an open field so as to clean the pipe end both chemically and mechanically while recovering both residue and cleaning fluids so as to protect the environment.

SUMMARY OF THE INVENTION

The instant invention comprises a lightweight portable housing that can be placed over successive pipe ends to power clean pipe ends or pipe threads both mechanically and chemically without polluting the environment and under all weather oilfield conditions. So as to make the housing as light and portable as possible, most of the mass of the invention is positioned remotely from the housing and serves the housing through light flexible connecting members. Power sources, storage tanks and transport vehicle are located at the other ends of the flexible members. Operating controls are located on the housing for safety and for efficiency.

DESCRIPTION OF THE PREFERRED EMBODIMENT

Figure 1:
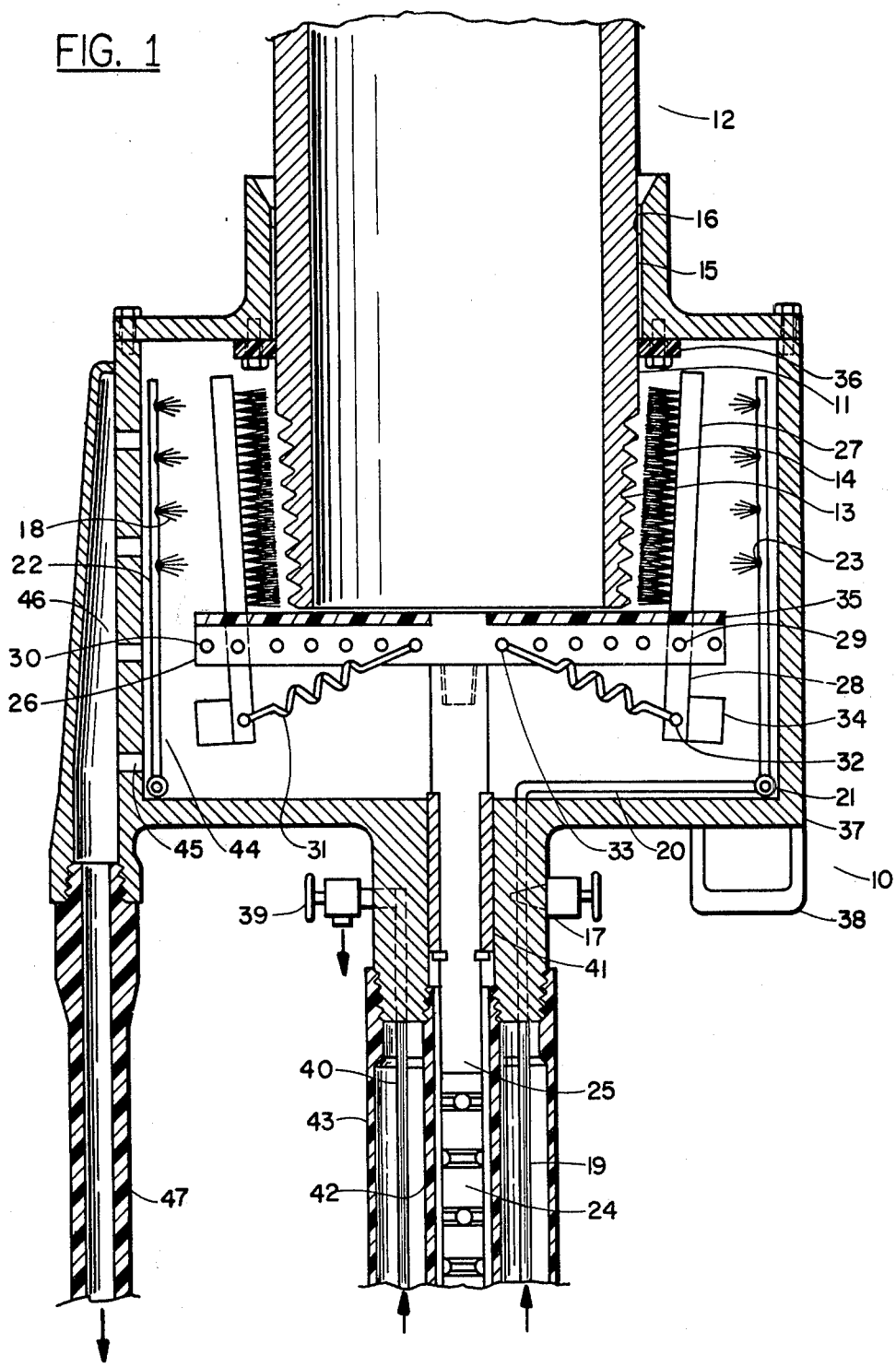
FIG. 1 discloses a housing assembly for cleaning an external pipe thread.

As show in FIG. 1, housing assembly 10 is manually placed over end 11 of pipe 12 such that external threads 13 are radially positioned with respect to brush bristles 14; the angular and concentric alignment of housing assembly 10 with respect to the outer surface 15 of pipe 12 is sufficiently maintained by bore 16 of housing assembly 10. Opening of valve 17 allows cleaning fluid 18 to pass from flexible hose 19 into pipe 20, thence to arcuate pipe 21 and thence to a plurality of pipes as at 22 being formed with nozzles as at 23 so as to direct fluid 18 toward threads 13.

Flexible shaft 24, being driven by a remote motor to be described below, rotates shaft 25 which in turn causes a plurality of radially projecting arms as at 26 to rotate, causing brushes as at 27 to rotate about shaft 25. Handle 28 of brush 27 is pivotably mounted to arm 26 as at 29 to position brush 27 at the proper radial distance for cleaning thread 13. Mounting of brush 27 for the cleaning of other diameter threads as at 30 is provided for by a plurality of mounting means in arm 26. One end of spring 31 is affixed to one end of brush handle 28 as at 32, the other end of spring 31 being affixed to arm 26 as at 33 so as to maintain bristles 14 apart from thread 13 when shaft 25 is not rotating. Weight 34 is adjustably mounted along handle 28 so that its position along handle 28 may be made suitable to a variety of conditions, the magnitude and position of weight 34 being sufficient at the rotational speed of shaft 25 to develop centrifugal force sufficient to overcome the force of spring 31 and rotational forces on brush 27 so as to cause brush 27 to pivot thereby moving bristles 14 into contact with thread 13 with proper force for the desired cleaning action of thread 13.

Resilient member 35 is mounted as on arm 26 so as to limit axial movement of housing assembly 10 onto pipe 12 and thereby position bristles 14 radially with respect to thread 13. Sealing member 36 is suitably mounted to housing assembly 10 inwardly of and adjacent to bore 16 of housing assembly 10 so as to contact pipe surface 15 and effectively prevent loss of fluid 18 through bore 16 while being sprayed from nozzles 23.

Shell 37 of housing assembly 10 is made of strong and lightweight material such as a fiberglass resin composite or the like so as to facilitate handling, durability and safety. Handles as at 38 may be provided as required for convenience of the operator.

Control valve 39 when closed, causes control line 40 to be pressurized which controls the rotation of flexible shaft 24, to be further explained below. Bearing 41 provides proper support for shaft 25. Flexible sheath 42 encloses flexible shaft 24 as is well known in the art to provide for its proper operation. Flexible hose 43 encloses sheath 42, fluid hose 19 and control line 40 thereby protecting them from damage and reducing the number of hoses to be handled.

After cleaning, fluid 18 is sprayed from nozzles 23 toward threads 13. Both fluid 18 and matter cleaned from threads 13 fall to bottom 44 of shell 37; thence through drain paths as at 45 into sump 46 formed below shell 37; thereafter passing into drain hose 47 and flowing toward tank 48 shown in FIG. 2, being assisted by a partial vacuum in hose 47 created by venturi inducer 49 well known in the art.

Compressor 50 supplies compressed air through manifold 51 to inducer 49, air valve 52 and cleaning fluid supply tank 53. Regulators as at 54 may be set to maintain proper air pressures for each use. Air from manifold 51 enters the top of supply tank 53 to pressurize cleaning fluid within to thereby cause cleaning fluid to flow out through hose 19, valve 17, pipe 20, pipe 21, pipes as at 22 and out nozzles 23 as at 18 toward thread 13.

Depressurization of control line 40 by the opening of valve 39 causes pilot valve 55 to open air valve 52 and thereby actuate rotary air motor 56 which rotates flexible shaft 24, the construction and operation of such devices being well known in the art.

A vehicle 57 may be furnished for mobile mounting of any of the system as desired, provided that the housing assembly and its connecting flexible lines remain portable within the reach of the flexible lines. Anchor 58 secures the end of flexible hose 43 to vehicle 57 so as to prevent tension loads on the smaller members therein.

Figure 3:
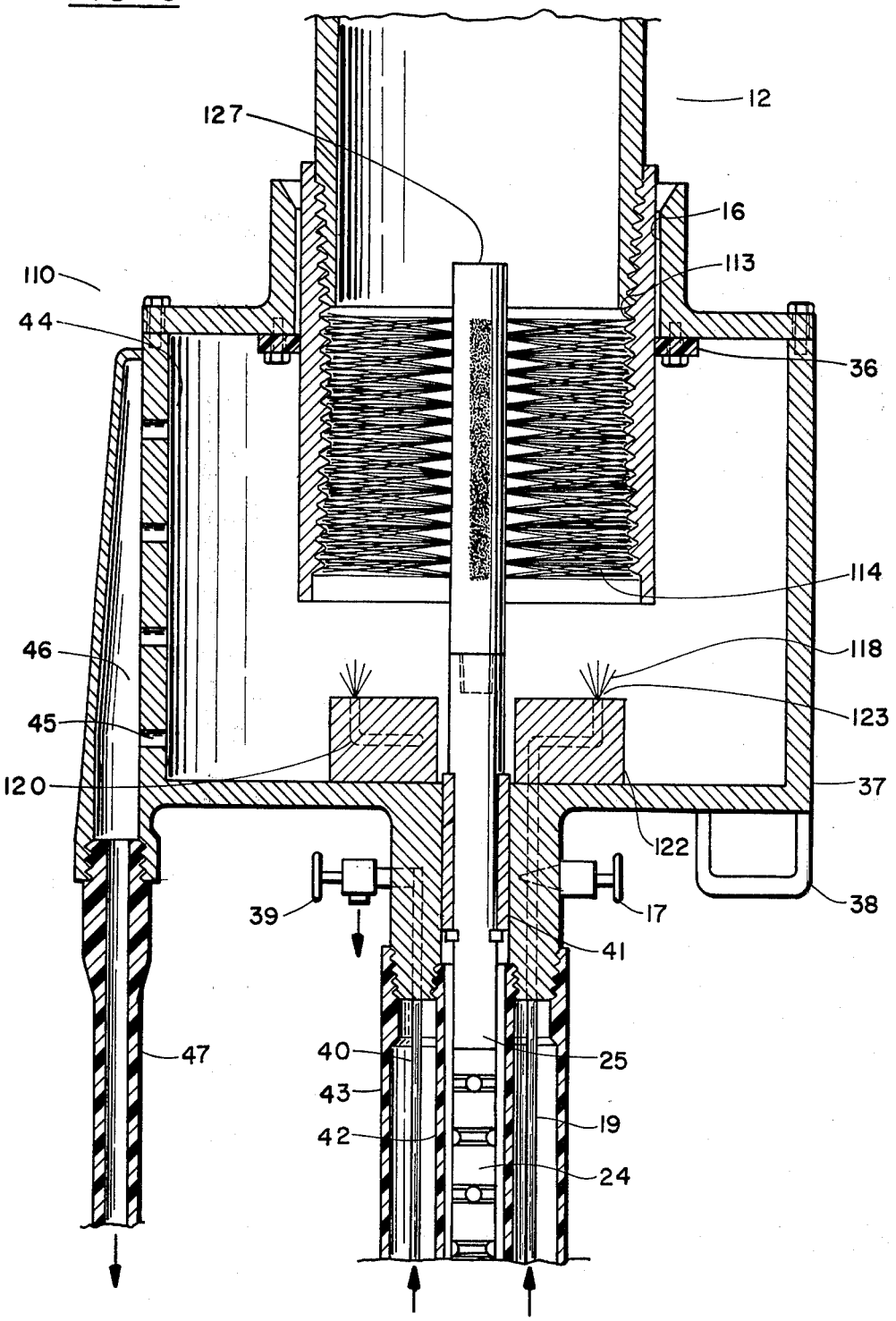
FIG. 3 discloses a housing assembly for cleaning an internal pipe thread.

FIG. 3 discloses a housing assembly 110 arranged for the cleaning of an internal pipe thread 113, differing from assembly 10 as follows; the brush assembly consisting of arms 26, springs 31, brushes 27, weights 34 and resilient members 35 are replaced by rotary brush 127; pipe 20, 21 and 22 are replaced by block 122, conduits 120 and nozzles 123. Bristles 114 of rotary brush 127 are sufficiently flexible so as to allow insertion into internal threads 113 without retracting means as provided for brushes 27.

OPERATION OF THE INVENTION

Figure 2:
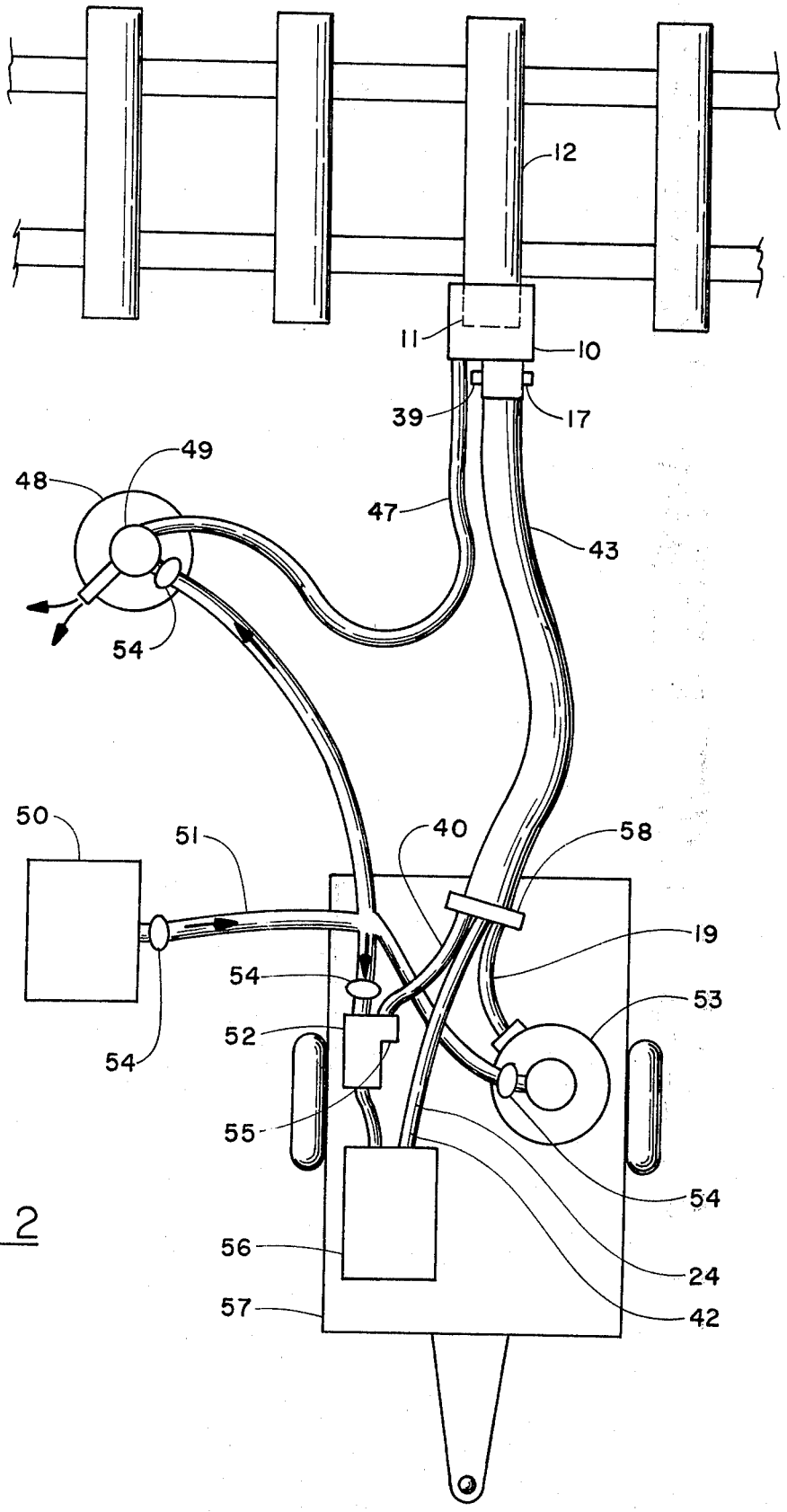
FIG. 2 illustrates a general arrangement of the entire system.

The mobile unit is set up per FIG. 2 so that the pipe end 11 to be cleaned is within reach of flexible hose 43 attached to housing assembly 10 or 110 as desired. With cleaning fluid in tank 53, and manifold 51 supplied with compressed air, said housing is placed over pipe end 11 to be cleaned. Valve 17 is opened to begin delivery of cleaning fluid to the pipe end and valve 39 is closed to start rotation of the brush or brushes, thereby effecting a simultaneous mechanical and chemical cleaning action of the pipe end. Spent cleaning fluid and matter cleaned from pipe end 11 falls to bottom 44 of shell 37 and thence through paths 45 into sump 46 to be drawn down drain hose 47 to tank 48, being assisted by a partial vacuum created by venturi inducer 49. After cleaning of each pipe end, valve 39 is opened to stop brush rotation, valve 17 is closed to stop flow of cleaning fluid and the housing assembly is removed from that pipe end and placed on another pipe end.

When an external thread is to be cleaned, housing assembly 10 is used with the specific operation as follows: the opening of valve 17 causes cleaning fluid to flow into pipes 20, 21 and 22 and to spray out nozzles 23 as at 18 toward thread 13; rotation of shaft 25 causes rotation of arms 26, springs 31, brushes 27, resilient members 35 and weights 34; the rotation of weights 34 causing sufficient centrifugal force to cause brushes 27 to pivot and bring bristles 14 into cleaning contact with threads 13 until rotation is stopped by the opening of valve 39, thereby allowing springs 31 to cause brushes 27 to pivot so that bristles 14 are no longer in contact with threads 13, allowing for easy removal of housing assembly 10 from pipe end 11 and its positioning over a next pipe end to be cleaned.

When internal pipe threads are to be cleaned, housing assembly 110 is placed over pipe end 11 with specific operation as follows: the opening of valve 17 causes cleaning fluid to flow into conduits 120 of block 122 and thence out a plurality of nozzles 123 as at 118 toward thread 113; the closing of valve 39 causes rotation of shaft 25 and rotary brush 127, whereupon bristles 114, being already in cleaning contact with threads 113, effect a mechanical cleaning action of threads 113. The installation or removal of housing assembly 110 does not require retraction of bristles 114 because bristles 114 are long and flexible.

Thus, by placing the housing over a pipe end and by adjusting two small valves, the operator can quickly, safely and properly clean a pipe end under rugged oilfield conditions and without damage to the environment and thence easily clean successive pipe ends without the need to move the pipe.

I claim:

1. An apparatus for cleaning thread on a pipe comprising a portable housing for positioning over an end of said pipe; said housing having a first end and a second end with said first end having an opening for receiving the pipe end and pipe threads; said housing including a rotatable rigid shaft mounted to the second end concentrically with the opening in the first end, a plurality of radial arms of said rigid shaft positioned around its periphery, an aperture in each of said radial arms suitable for receiving a pivot pin, a pivot pin mounted in the aperture of each radial arm, brushes positioned radially with respect to the pipe threads and pivotally mounted on said pivot pins so as to allow movement of said brushes between a position of contact with the threads and a position of no contact, a spring attached to each of said brushes and to its respective radial arm so as to cause said brushes to lose contact with said threads when said rigid shaft is not rotating, and a weight attached to each of said brushes so as to cause, when said rigid shaft is rotated, a centrifugal force sufficient to overcome said spring to thereby force said brushes into contact with said threads; a flexible shaft exterior of said housing for driving said rigid shaft; motor means for driving said flexible shaft; said motor means being remote from said housing such that movement of said housing does not require the movement of said motor means; said housing including means for supplying cleaning fluid to said threads; and said housing further including means for recovering substantially all of said cleaning fluid.

2. The invention of claim 1 wherein said cleaning fluid supply means comprises at least one nozzle to direct said cleaning fluid to the surface being cleaned; at least one conduit mounted within said housing to supply cleaning fluid to said nozzle; a flexible hose having one end attached to said conduit and the other end attached to a fluid source, said source being remote from said housing such that the movement of said housing does not require the movement of said fluid source.

3. The invention of claim 1 wherein said cleaning fluid recovery means comprises a sump positioned at the bottom of said housing to gather said fluid after falling below said pipe; a flexible return hose having one end attached to said sump and the other end attached to a storage tank, said storage tank being remote from said housing such that the movement of said housing does not require the movement of said storage tanks, to enable the fluid to readily flow from said sump to said tank.

4. The invention of claim 1 wherein said housing further comprises a shell of light material such as fiberglass or the like sufficient to prevent escape of said fluid except through said sump; and wherein the opening in the first end of said housing is sufficient to slide over said pipe and maintain concentric an angular alignment of said housing with said pipe by contacting adjacent surface of said pipe other than said threads; and wherein said housing further comprises an axial positioning surface within said housing to contact an end of said pipe to thereby position said housing axially such that said brushes are positioned radially to said threads.

5. The invention of claim 1 further comprising an angular resilient seal between the first end of said housing and the adjacent surface of said pipe so as to prevent escape of said fluid through said opening in said first end.

6. The invention of claim 1 wherein each of said radial arms further comprises a plurality of apertures formed at successive distances from the center of said rigid shaft and suitable for receiving the pivot pins and wherein one of said pivot pins is mountable in the aperture of each radial arm which is most suited to the diameter of the threads to be cleaned.

7. An apparatus for cleaning threads on a pipe comprising a portable housing for positioning over an end of said pipe; said housing having means for mechanically cleaning said threads; a rotatable flexible shaft contained within a flexible sheath for driving said mechanical cleaning means, said flexible shaft being connectable to motor means located remotely from said portable housing; a flexible fluid supply hose for supplying cleaning fluid to said housing; flexible control line means for controlling the operation and rotation of said motor means; said flexible sheath, said flexible fluid supply hose and said flexible control line means all being external to said housing and all being contained together within another flexible hose attached to said housing.

8. The invention of claim 7 further comprising a flexible fluid recovery hose connected to said housing and connectable to a remote storage tank; said flexible fluid recovery hose being sufficiently rigid to resist collapse against a vacuum; and means for maintaining a partial vacuum within said fluid recovery hose so as to facilitate the flow of fluid from said housing to said storage tank.

9. The invention of claim 7 further comprising means mounted on said housing and said control line means for operating said control line means and means mounted on said housing for controlling the flow of said cleaning fluid through said flexible fluid supply hose to said housing.

* * * * *